United States Patent [19]

Helgesson

[11] Patent Number: 4,651,962

[45] Date of Patent: Mar. 24, 1987

[54] HOLDER FOR HOUSEHOLD IMPLEMENTS, ESPECIALLY A CAN OPENER

[75] Inventor: Stig B. J. Helgesson, Vejbystrand, Sweden

[73] Assignee: AB Konstruktions-Bakelit, Sweden

[21] Appl. No.: 847,179

[22] PCT Filed: Jun. 7, 1985

[86] PCT No.: PCT/SE85.00237

§ 371 Date: Mar. 10, 1986

§ 102(e) Date: Mar. 10, 1986

[87] PCT Pub. No.: WO86/00007

PCT Pub. Date: Jan. 3, 1986

[30] Foreign Application Priority Data

Jun. 8, 1984 [SE] Sweden ..... 8403100

[51] Int. Cl.[4] ..... A47F 5/00

[52] U.S. Cl. ..... 248/309.1; 30/433; 30/434; 30/435; 403/349

[58] Field of Search ..... 403/348, 349, 24; 248/309.1, 225.1, 300, 316.1; 30/433, 434, 435

[56] References Cited

U.S. PATENT DOCUMENTS

| | | | |
|---|---|---|---|
| 385,486 | 7/1888 | Thurber | 248/309.1 X |
| 2,833,158 | 5/1958 | Damon | 403/349 X |
| 3,540,686 | 11/1970 | Bryse | 248/309.1 X |
| 4,138,055 | 2/1979 | Harrison | 248/309.1 X |
| 4,532,672 | 8/1985 | Anderson | 403/349 X |
| 4,575,881 | 3/1986 | Rozek | 403/349 X |
| 4,580,665 | 4/1986 | Saxton et al. | 403/24 X |

FOREIGN PATENT DOCUMENTS

| | | |
|---|---|---|
| 0020151 | 12/1980 | European Pat. Off. . |
| 0104152 | 3/1984 | European Pat. Off. . |
| 2546980 | 10/1979 | Fed. Rep. of Germany . |
| 2168323 | 8/1973 | France . |
| WO80/01159 | 6/1980 | World Int. Prop. O. . |
| WO82/03376 | 10/1982 | World Int. Prop. O. . |
| 342210 | 1/1972 | Sweden . |
| 7113934-9 | 5/1975 | Sweden . |

*Primary Examiner*—Ramon O. Ramirez
*Attorney, Agent, or Firm*—Bacon & Thomas

[57] ABSTRACT

A holder for household implements, especially a can opener, comprises a bracket (10) attached to a supporting surface and having at its end facing away from the supporting surface a transverse circular opening. A member of the casing (12) of the household implement is cylindrical and insertable in the opening from either side of the bracket (10). The casing member has two sets of axially spaced-apart ridges (22, 24). The first outer set constitutes bayonet joint ridges (22), corresponding bayonet joint ridges (26) on a clamping ring (14) being turned to engage with said first bayonet joint ridges (22) to secure the casing member in the opening in that the ring (14) and an abutment (13) on the casing (12) are pressed against the opposite sides of the bracket. The casing member is insertable in the opening of the bracket (10) in different turning positions and is kept in the desired position by the second inner set of ridges (24) which fit between ridges (19) arranged on the circumferential surface of the opening half-way between the ends of the opening. Preferably, the two sets of ridges (22, 24) on the casing (12) have the same circumferential extension and are arranged axially opposite one another such that the two sets can be pushed between the ridges (19) of the opening, the casing (12) being in the same turning position.

3 Claims, 5 Drawing Figures

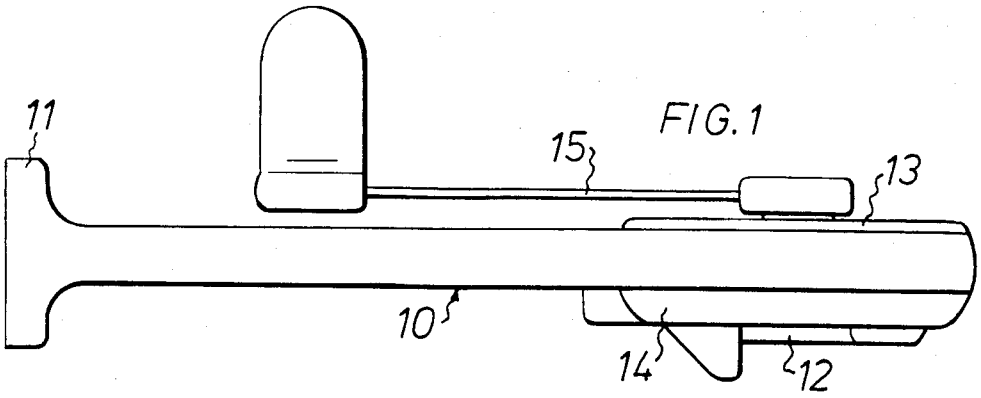
FIG. 1
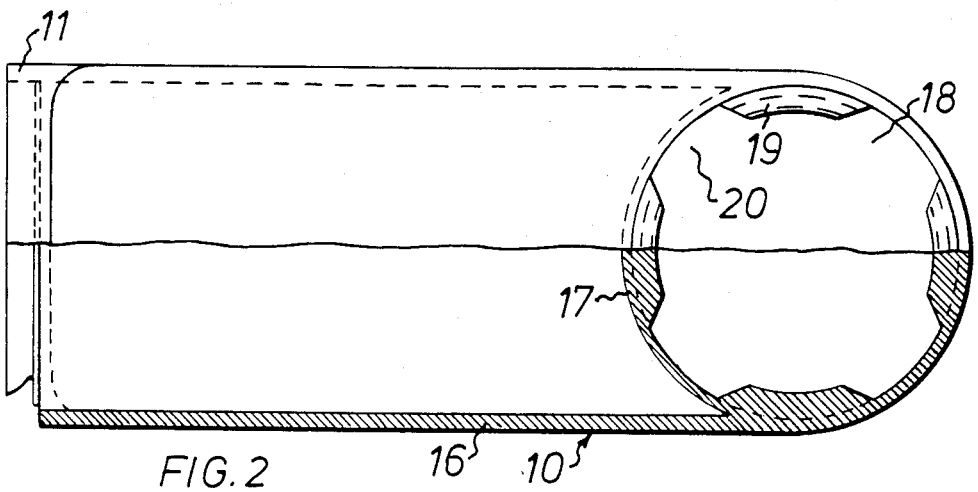
FIG. 2
FIG. 3
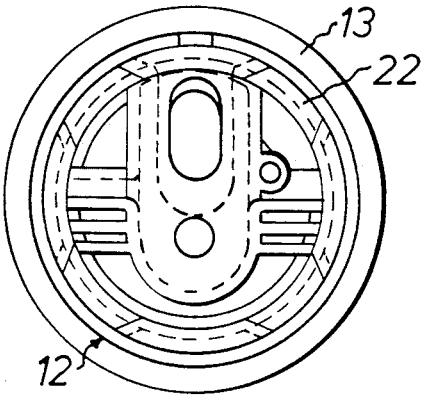
FIG. 4
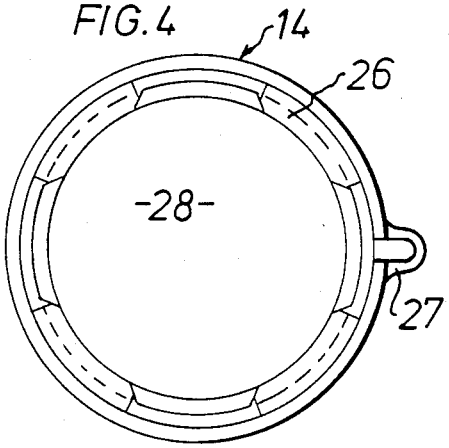

HOLDER FOR HOUSEHOLD IMPLEMENTS, ESPECIALLY A CAN OPENER

The present invention relates to a holder for household implements, especially a can opener, comprising a bracket which at one end is adapted to be attached to a supporting surface and at the other end has a mounting for a casing of the household implement.

Wall-mounted holders for can openers have been known for many years. They suffer from the disadvantage that they can be mounted on a vertical surface only, and furthermore they are normally obtainable only in a design in which the can opener is mounted for right-handed persons, which is inconvenient to the left-handed operator. The object of the present invention is to eliminate this disadvantage and to provide a holder for household implements that can be mounted on vertical, horizontal and inclined surfaces and besides facilitates attaching of the implement such that it can be used by left-handed as well as right-handed persons. To this end, the mounting for the casing of the household implement consists of a transverse through opening in the bracket, in which opening a member formed in one piece with the casing is insertable from either side of the bracket in the desired turning position until means arranged on said casing member to counteract turning engage with corresponding means in the opening, and an abutment on the casing abuts the side of the bracket from which the casing member is inserted; that at least the outer or free end portion of the member insertable in the opening is cylindrical and has bayonet joint ridges arranged after each other in the circumferential direction; and that a clamping ring having bayonet joint ridges corresponding to said ridges is adapted to be slipped over the cylindrical end portion and turned, the surfaces of the two sets of bayonet joint ridges, which are facing each other and inclined relative to the circumferential direction, abutting each other until the clamping ring and the abutment of the casing are firmly pressed against the opposed sides of the bracket.

The invention will be described in detail below, reference being had to the accompanying drawings illustrating an embodiment chosen by way of example.

FIG. 1 is a top plan view of a holder according to the invention, in which a can opener adapted to be used by a right-handed person is mounted;

FIG. 2 is a lateral view, partly in section, of the main portion of the holder shown in FIG. 1, i.e. a bracket adapted to be attached to a supporting surface;

FIG. 3 is a lateral view of a casing for receiving the household implement, said casing having a lid on one surface;

FIG. 4 shows a clamping ring for clamping the casing in a bracket opening provided therefor.

Figure 5:
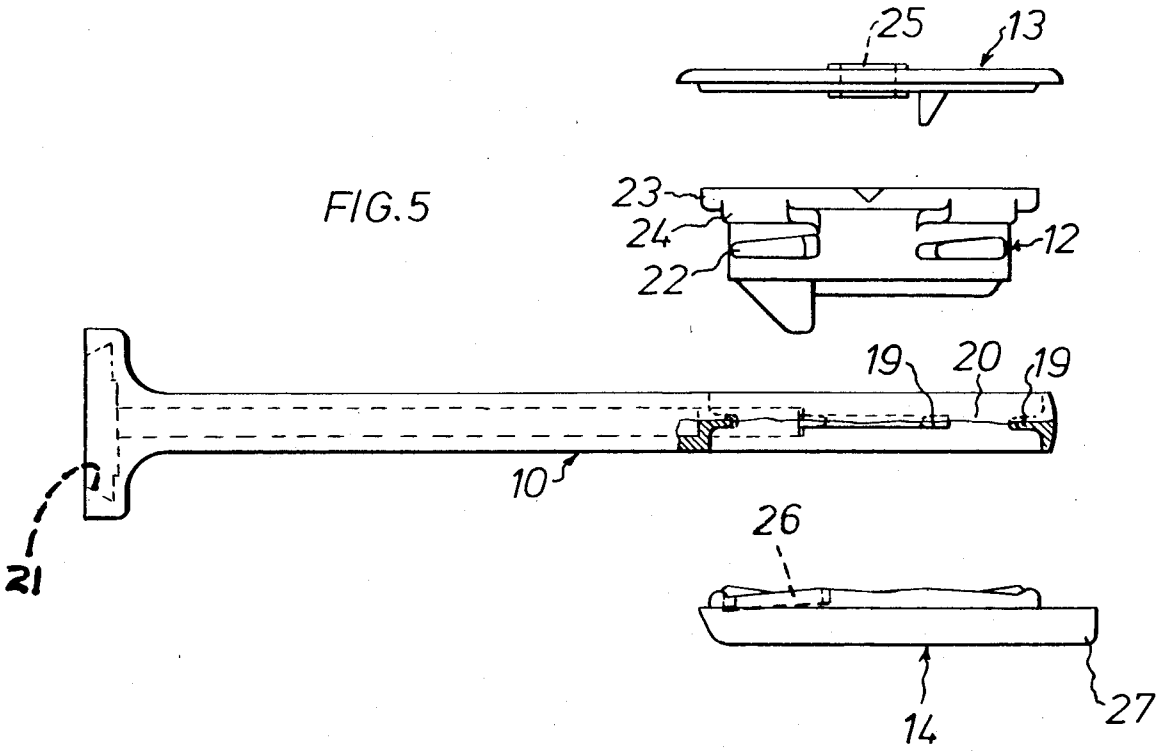
FIG. 5 is an exploded top plan view of a holder according to the invention.

FIG. 1 is a top plan view of a holder which has been manufactured according to the invention and in which the can opener is mounted. The holder comprises a bracket 10 which at one end has an attachment member 11 for attachment to a supporting surface. In an opening in the end of the bracket 10 facing away from the attachment 11, a casing 12 is mounted in which the household implement, in this case a can opener, is mounted. The casing 12 is retained in the opening by means of a lid 13 on one side of the casing 12 and a clamping ring 14 on the other side of said casing, said clamping ring engaging with the casing by means of a bayonet joint as described in detail below. In conventional manner, a crank 15 is provided for operating the can opener. The can opener as shown is adapted to be used by a right-handed person but, as is evident from the following, the opener can easily be modified such that it can be used also by a left-handed person. The can opener proper may be of highly conventional type and therefore is not shown or described in detail below.

The main part of the holder is the bracket 10, whose end portion 11 is adapted to be attached to a wall by means of a plate fastened to the wall with screws and having a projection portion dovetailed in cross-section and adapted to be received in an undercut groove 21 (FIG. 5) in the bracket portion 11. The bracket 10 is hollow and has boundary walls 16 to which two semicircular walls 17 are connected at one end of the bracket 10 for defining a through opening 18. In the opening 18, half-way between the flat sides of the bracket, four circular arc-shaped portions 19 are formed in one piece with the wall defining the opening 18, and between these projecting portions 19, sub-openings 20 are provided. The projecting portions 19 have a thickness in the axial direction of the opening 18 of about one fourth of the thickness of the bracket 10, as shown in FIG. 5. Furthermore, the portions 19 are arranged half-way between the flat sides of the bracket 10. The bracket 10 thus is symmetrical on both sides of its centre plane perpendicular to the plane of the drawing in FIG. 5.

The casing 12 adapted to be positioned in the opening 18 of the bracket 10 is shown in FIG. 3 from the end which corresponds to the lowermost end in FIG. 5. The casing 12 is nearly cylindrical and specially designed, internally as well as in its two opposite end surfaces, for receiving the household implement, in this case the can opener. These parts of the casing therefore are not discussed in detail. On its cylindrical circumferential surface, the casing has four uniformly spacedapart circular arc-shaped projections 22 which taper radially outwardly and, in their circumferential direction, have a length corresponding to the length of the sub-openings 20 between the portions 19 in the opening 18. Around one flat side of the casing 12, in FIG. 5 the uppermost, an annular portion 23 is formed in one piece with the casing and has a diameter corresponding to the diameter of the opening 18. Shoulders 24 are formed in one piece with this portion 23 on the inside thereof. The outwardly facing boundary surface of these shoulders 24 extends parallel to and at the same height as the outer boundary surface of the ring 23 and the projections 22. The side of the projections 22 facing the ring 23 is slightly inclined upwards to the right in FIG. 5. As will be explained below, the projections 22 constitute bayonet joint means. The projections 22 and the shoulders 24 are positioned axially opposite one another. The casing 12 is insertable in the opening 18 of the bracket 10, and the projections 22 and the shoulders 24 are positioned opposite the sub-openings 20 between the projecting portions 19 in the opening 18 of the bracket 10, the projections 22 passing the sub-openings 20, but the shoulders 24 being retained therein with the portions 19 on either side of the shoulders. Then the inwardly facing surface of the ring 13 abuts the side of the arc-shaped portions 19 which is facing the bracket flat side from where the casing 12 is inserted. It is evident that the casing 12 can be inserted from either side of the bracket 10.

When the casing 12 has been inserted in the opening 18 in the bracket 10, its flat side provided with the ring 23 and, respectively, the outwardly facing side of the ring 23 are flush with the flat side of the bracket 10. To cover the joint between the casing 12 and the boundary surface of the opening 18 and to cover that part of the household implement which is positioned in the casing, a lid 13 is connected with the outer side of the casing 12. The lid 13 has an aperture for the stub shaft of the crank 15 shown in FIG. 1.

To retain the casing 12 in the opening 18 of the bracket 10, the clamping ring 14 shown in FIGS. 4 and 5 is used. The clamping ring 14 defines a circular opening 28, and four arc-shaped projections 26 project a predetermined distance into the opening. The projections 26 extend in the circumferential direction a distance which is slightly smaller than the distance between two juxtaposed projections 22 on the casing 12, and furthermore, the projections 26 are, as shown in FIG. 5, arranged in the vicinity of one flat side of the ring 14, while the ring adjacent its other flat side has an inwardly bent, annular flange. An operating lug 27 is formed in one piece with the ring 14 to facilitate turning of the ring, as will be explained below.

To safely anchor the casing 12 inserted, in the manner described above, in the opening 18 of the bracket 10, the ring 14 is pulled over the casing portion projecting from one flat side of the bracket, in FIG. 5 the lowermost side, the distance between the inner boundary surface of the arc-shaped projections 26 slightly exceeding the diameter of the cylindrical casing member, and if the projections 26 are positioned between the projections 22 of the casing, the former can pass the latter. Like the casing projections 22, the projections 26 have an inclined surface and thus form the other part of a bayonet joint such that by turning the ring 14 and the subsequent engagement between the inclined surfaces of the projections 22 and 26, respectively, the casing 12 and the ring 14 are pulled together and against the opposite flat sides of the bracket 10. Thus, the casing 12 can be safely anchored in the opening 18 of the bracket 10.

As will be seen from the drawings, the casing 12 can be inserted in the opening of the bracket 10 from both the upper and the lower flat side in FIG. 5 and be attached by means of the clamping ring 14 to the opposite flat side. This means that the household implement in the casing 12 can be utilised by right-handed as well as left-handed persons. Furthermore, the casing can be inserted at different turning angles in the opening 18, which makes it possible to mount the holder on both a vertical and a horizontal surface. It will be appreciated that, if the number of projecting arc-shaped portions in the opening 18 and shoulders 24 on the casing 12 is increased, it is also conceivable to mount the bracket 10 on an inclined surface. However, the bracket is usually mounted on a wall, on the underside of a ceiling-mounted kitchen cupboard, or on a work-bench. In the embodiment shown, the projections 22 of the casing are positioned opposite the shoulders 24 (FIG. 5), which means that the casing can be pushed through the opening 18, which is preferred for convenience, but the projections 22 and the shoulders 24 may also be circumferentially displaced relative to each other, in which case the projections 22 must first be pushed through the sub-openings 20 between the portions 19 of the opening 18, whereupon the casing must be turned such that the shoulders 24 fit into the sub-openings 20.

In the position of use, in which the inner side of the ring 23 of the casing abuts the surface of the arc-shaped portions 19 which faces one flat side, the shoulders 24 are positioned between the portions 19 in the opening 18, and the projections 26 of the ring 14 have been wedged up with the projections 22 of the casing 12 into bayonet engagement, the casing 12 and thus the household implement are safely and firmly held by the bracket 10 attached to the supporting surface. The holder is adapted primarily for can openers of the well-known crank-operated type, as will appear from FIG. 1, but it is also possible to replace the casing by one having a whisk holder, spice-mill or the like. In that case, a releasable crank or some other drive may be advantageous such that the casing can be inserted in the opening 18 of the bracket 10 crank side first, the lid lying on the implement side.

I claim:

1. A holder for household implements, especially a can opener, comprising a bracket (10) which at one end (11) is adapted to be attached to a supporting surface and at the other end has a mounting for a casing (12) of the household implement, characterised in that said mounting for said household implement casing (12) consists of a transverse through opening (18) in said bracket (10), in which opening (18) a member formed in one piece with the casing (12) is insertable from either side of the bracket (10) in the desired turning position until means (24) arranged on said casing member to counteract turning engage with corresponding means (19) in the opening (18), and an abutment (13) on the casing (12) abuts the side of the bracket (10) from which the casing member has been inserted; that at least the outer or free end portion of the member insertable in the opening (18) is cylindrical and has bayonet joint ridges (22) arranged after each other in the circumferential direction; and that a clamping ring (14) having bayonet joint ridges (26) corresponding to said ridges (22) is adapted to be slipped over the cylindrical end portion and turned, the surfaces of the two sets of bayonet joint ridges (22, 26), which are facing each other and inclined relative to the circumferential direction, abutting each other until the clamping ring (14) and the abutment (13) of the casing (12) are firmly pressed against the opposed sides of the bracket.

2. A holder as claimed in claim 1, characterised in that said opening (18) in the bracket (10) is circular and the insert member of the casing (12) is cylindrical in its entirety, and that the relative nonrotatability of the casing (12) and the bracket (10) is provided by means of circumferential projections (19) along the circumference of the opening half-way between the ends of the opening, said projections (19) being arranged with interspaces in which locking ridges (24) on the insert member are adapted to be fitted when said insert member is fully inserted in the opening (18).

3. A holder as claimed in claim 2, characterised in that said locking ridges (24) and said bayonet joint ridges (22) have the same circumferential extension and are positioned axially opposite one another.

* * * * *